US007418968B2

(12) United States Patent
Bang

(10) Patent No.: US 7,418,968 B2
(45) Date of Patent: Sep. 2, 2008

(54) DISHWASHER

(75) Inventor: Jong Chul Bang, Changwon-si (KR)

(73) Assignee: LG Electronics, Inc., Seoul (KR)

( * ) Notice: Subject to any disclaimer, the term of this patent is extended or adjusted under 35 U.S.C. 154(b) by 485 days.

(21) Appl. No.: 11/033,808

(22) Filed: Jan. 13, 2005

(65) Prior Publication Data

US 2005/0284505 A1 Dec. 29, 2005

(30) Foreign Application Priority Data

Jun. 24, 2004 (KR) ..... 10-2004-0047445

(51) Int. Cl.
*B08B 3/00* (2006.01)

(52) U.S. Cl. ..... 134/58 D; 134/56 D; 134/57 D

(58) Field of Classification Search ..... 134/56 D, 134/57 D, 58 D
See application file for complete search history.

(56) References Cited

U.S. PATENT DOCUMENTS 5,165,433 A * 11/1992 Meyers ..... 134/104.4
5,433,232 A * 7/1995 Young, Jr. ..... 134/111
6,432,216 B1 * 8/2002 Thies ..... 134/18

* cited by examiner

*Primary Examiner*—Michael Barr
*Assistant Examiner*—Jason Heckert
(74) *Attorney, Agent, or Firm*—McKenna Long & Aldridge LLP

(57) ABSTRACT

The present invention provides a dishwasher, by which noise and vibration of a wash motor can be lowered and by which endurance of the wash motor can be prolonged and by which an assembly of a wash motor and a sump can be simplified. The present invention includes a sump housing having a heater container containing a heater therein and at least one motor guide rib projected from a bottom of the heater container and a wash motor having a motor housing provided with a rib container containing the at least one motor guide rib therein.

8 Claims, 4 Drawing Sheets

DISHWASHER

This application claims the benefit of the Korean Application No. P2004-047445 filed on Jun. 24, 2004, which is hereby incorporated by reference.

BACKGROUND OF THE INVENTION

1. Field of the Invention

The present invention relates to a dishwasher, and more particularly, to a structure of a dishwasher, by which stable assembly of a sump and a wash motor is facilitated.

2. Discussion of the Related Art

Generally, a dishwasher is a machine for washing tableware automatically. Specifically, the dishwasher is a home appliance for cleansing tableware by removing filth from the tableware using a pressure of water sprayed from a spray nozzle.

A dishwasher according to a related art consists of a tub forming a washing room as a space for washing tableware therein, a sump provided to a bottom of the tub, and a wash pump attached to one side of the sump to pump water stored in the sump via a spray nozzle. And, the dishwasher further consists of a wash motor driving the wash pump, a drain pump for draining the water after use, and a drain motor driving the drain pump.

The wash pump of the related art dishwasher is provided to a lateral side of the sump and the wash motor driving the wash pump is provided to a rear side of the wash pump. Alternatively, the wash pump is provided within the sump and the wash motor driving the wash pump is provided under the sump.

However, the related dishwasher brings about the following problems.

First of all, the wash motor fails to be installed at a center of the sump, whereby its noise and vibration are increased. And, endurance of the wash motor is shortened.

Secondly, an assembly structure of the related art dishwasher is complicated since the wash motor fails to be installed at a center of the sump.

SUMMARY OF THE INVENTION

Accordingly, the present invention is directed to a dishwasher that substantially obviates one or more problems due to limitations and disadvantages of the related art.

An object of the present invention is to provide a dishwasher, by which noise and vibration of a wash motor can be lowered and by which endurance of the wash motor can be prolonged.

Another object of the present invention is to provide a dishwasher, by which an assembly of a wash motor and a sump can be simplified.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dishwasher according to the present invention includes a sump housing having a heater container containing a heater therein and at least one motor guide rib projected from a bottom of the heater container and a wash motor having a motor housing provided with a rib container containing the at least one motor guide rib therein.

Preferably, a motor shaft penetrating hole is further provided to the sump housing to insert a motor shaft of the wash motor therein.

More preferably, the motor shaft penetrating hole is provided to a bottom center of the sump housing.

More preferably, the motor guide rib is formed on a circumference having a predetermined radius from the motor shaft penetrating hole.

More preferably, one end of the motor guide rib received in the rib container has a hook shape.

Preferably, at least one motor connecting boss is provided to a bottom of the sump housing and at least one motor connecting wing is provided to the wash motor to correspond to the at least one motor connecting boss.

More preferably, the at least one motor connecting boss is provided to one later side of the heater container to have a predetermined length and the at least one motor connecting wing is provided to a rim of the motor housing.

More preferably, inserting holes are provided to the at least one motor connecting boss and the at least one motor connecting wing, respectively to insert a locking member therein.

More preferably, a location setting hole for assisting a location setting of the wash motor is provided to the at least one motor connecting wing and a location setting projection is provided to the bottom of the sump housing to correspond to the location setting hole.

More preferably, the location setting projections are arranged to confront each other diagonally.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
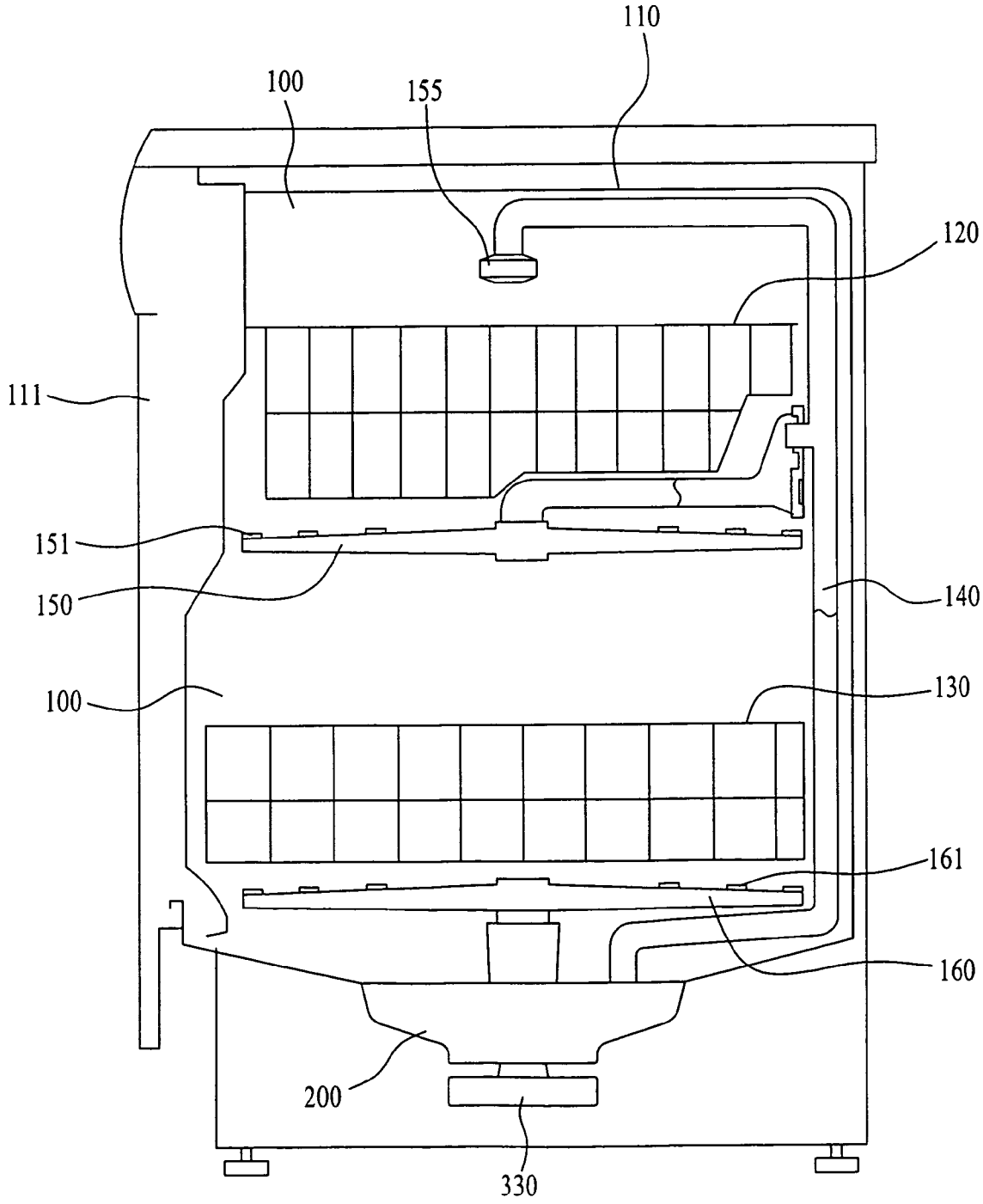
FIG. 1 is a cross-sectional diagram of a dishwasher according to one embodiment of the present invention.

FIG. 1 is a cross-sectional diagram of a dishwasher according to one embodiment of the present invention.

Referring to FIG. 1, a dishwasher according to one embodiment of the present invention includes a tub 110 forming a washing room 100 as a space for washing tableware therein, a door 111 provided to a front portion of the tub 110 to open/close the washing room 100, and a sump 200 provided to a bottom center of the tub 110.

Provided over the sump 200 are a water guide 140 for supplying water, racks 120 and 130 holding tableware to be washed therein, and spray arms 150 and 160 spraying water to the racks 120 and 130, respectively.

The rack 120 is an upper rack 120 provided to an upper part of the tub 110 and the other rack 130 is a lower rack 130 provided to a lower part of the tub 110. The upper and lower racks 120 and 130 are supported by rails provided to a lateral inside of the tub 110, respectively. And, each of the upper and lower racks 120 and 130 is movable forward and backward.

The spray arms 150 and 160 include an upper spray arm 150 spraying water to the upper rack 120 and a lower spray arm 160 spraying water to the lower rack 130. An upper nozzle 151 is provided to the upper spray arm 150 to spray water upward and a lower nozzle 161 is provided to the lower spray arm 160 to spray water upward. Moreover, a top nozzle 155 connected to the water guide 140 is provided beneath a top portion of the tub 110 to spray water downward.

An operation of the above-configured dishwasher according to the present invention is explained as follows.

First of all, a user opens the door 111 of the dishwasher and pulls the upper rack 120 and/or the lower rack 130 outside the washing room 100. The user puts tableware on the racks 120 and 130 and then returns the tacks to the washing room 100. The door 111 is closed and power is then applied to actuate the dishwasher.

Once the dishwasher is actuated, water is introduced into the sump 200. After the water has been introduced into the sump 200, a wash motor 330 is driven so that a wash pump (not shown in the drawing) connected to the wash motor 330 can pump the water to the lower nozzle 161 and the water guide 140.

The water pumped to the water guide 140 is finally moved to the top and upper nozzles 155 and 151 to be sprayed into the washing room 100. Hence, the sprayed water washes the tableware received in the racks 120 and 130.

In doing so, the top nozzle 155 vertically sprays the water downward and the upper nozzle 151 vertically sprays the water upward, whereby the tableware received in the upper rack 120 can be washed. Meanwhile, the lower nozzle 161 vertically sprays the water upward to wash the tableware receive in the lower rack 130.

Optionally, another nozzle can be provided beneath the upper nozzle 151 to spray the water downward, whereby top and bottom portions of the tableware received in the lower rack 130 can be simultaneously washed.

After completion of a washing step of the dishwasher, the filthy water collected in the sump 200 is discharged outside the dishwasher via a drain pump (not shown in the drawing). After clean water is introduced into the sump 200, a rinsing step is carried out using the spray nozzles 151 and 161 in the same manner of the washing step.

After completion of the rinsing step, a drying step of drying the rinsed tableware is carried out to complete the dishwashing course.

Figure 2:
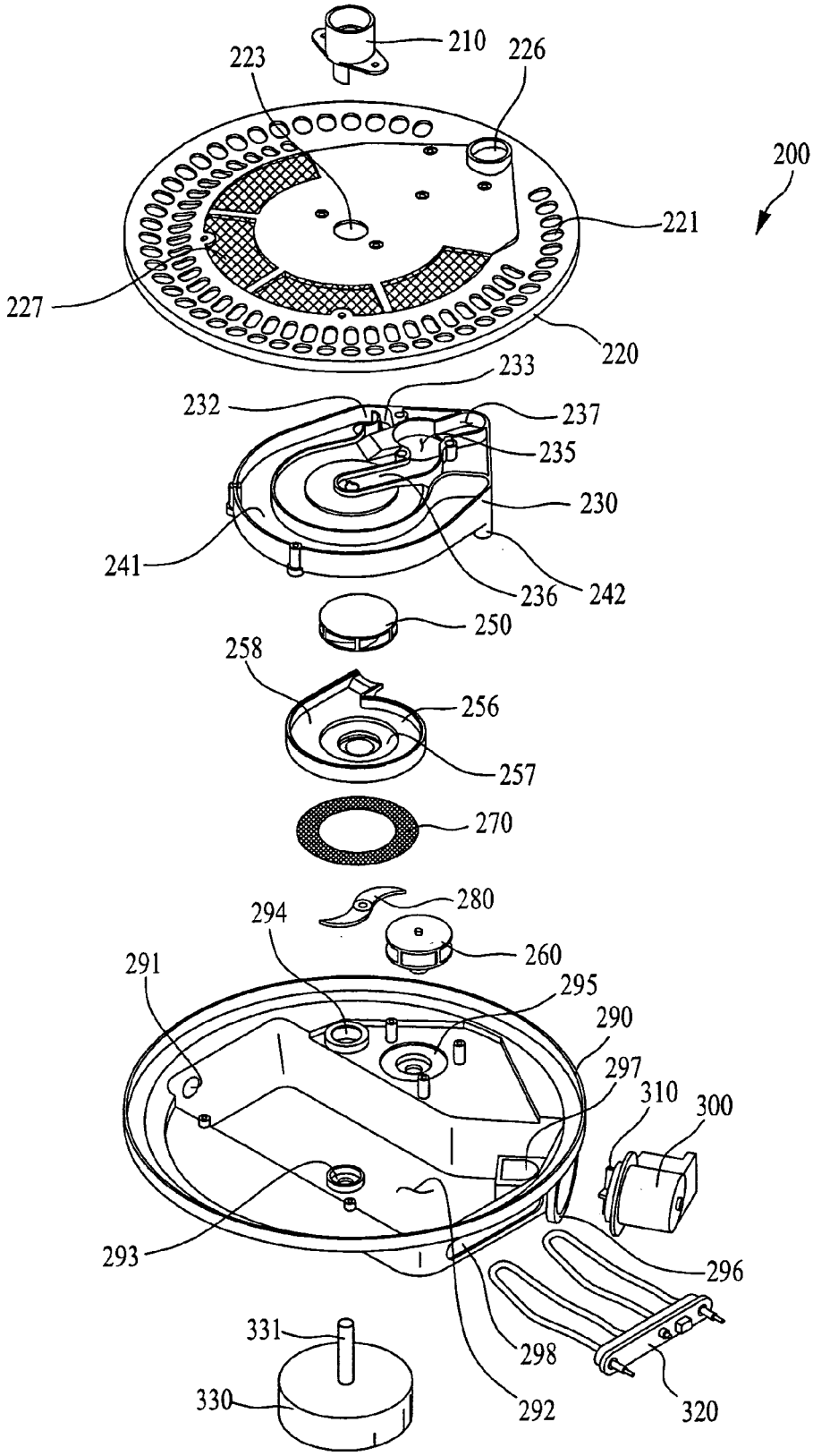
FIG. 2 is a projected perspective diagram of a sump of a dishwasher according to one embodiment of the present invention.

FIG. 2 is a projected perspective diagram of a sump of a dishwasher according to one embodiment of the present invention.

Referring to FIG. 2, a sump 200 includes a sump housing 290 forming an exterior of the sump and a wash motor 330 provided to a bottom of the sump housing 290.

The sump housing 290 includes a water supply hole 291 projected from one lower side, a drain pump case 296 provided to the other lower side of the sump housing 290, and a heater container 292 recessed from a central bottom of the sump housing 290 to a predetermined depth.

A motor shaft penetrating hole 293 is formed at a center of the heater container 292. And, a heater installing slot 298, via which a heater 320 is inserted, is formed at one side of the sump housing 290.

The drain pump case 296 is connected to a soil chamber drain recess 297, and a drain motor 300 is loaded in the drain pump case 296. Specifically, a drain impeller 310 is provided to a front portion of the drain motor 300. The drain impeller 310 is rotated within the drain pump case 296 to pump water, whereby the water is drained via a drain hose.

In the sump housing 290, a vario valve installing recess 295 is provided outside the heater container 292 and a soil sensor installing recess 294 is provided to leave a predetermined distance from the vario valve installing recess 295.

A motor shaft 331 is projected from a center of the wash motor 330. The motor shaft 331 is installed to penetrate the motor shaft penetrating hole 293 of the sump housing 290. And, the motor shaft 331 having penetrated the motor shaft penetrating hole 293 further penetrates a disposer 280 that disposes garbage.

A pump case 256 for pumping the water stored in the sump housing 290 and an impeller 250 contained in the pump case 256 to pump the water are provided over the disposer 280. Specifically, the motor shaft 331 penetrates a center of the impeller 250. Hence, as the motor shaft 331 is rotated, the impeller 250 is rotated to pump the water.

A lower filter 270 is provided between the disposer 280 and the pump case 256 to prevent a big piece of the garbage shattered by the disposer 280 from entering the pump case 256.

A soil chamber 230 having a passage for guiding a flow of the water pumped within the pump case 256 is provided over the pump case 256. And, a filter part 220 filtering the water from the soil chamber 230 is provided over the soil chamber 230. Moreover, a vario valve 260 is provided to one side of the soil chamber 230 to guide the water flowing via the passage to each spray nozzle selectively.

A multitude of wash water penetrating holes 221 and an upper filter 227 are formed on an edge area of the filter part 220 to primarily filter garbage directly detached from the tableware. And, an inserting hole 223 for loading a lower nozzle arm holder 210 connected to a lower nozzle is formed at a center of the filter part 220. Moreover, a sleeve 226 having a predetermined height and diameter is provided to one side edge of the filter part 220 to have a lower end of a water guide 140 fitted therein.

An installing hole 235 having the vario valve 260 loaded therein is provided to one side of the soil chamber 230. A lower nozzle guide channel 236 curved from the installing hole 235 is formed on an upper end of the soil chamber 230. And, a water guide channel 237 starting from the installing hole 235 is formed to guide the water to the sleeve 226.

Moreover, a drain channel 241 having a predetermined width and depth is provided to a rim of the soil chamber 230 along a shape of the soil chamber 230.

A soil sensor inserting recess 232 for loading a soil sensor therein is provided to one side of the drain channel 241 and a drain hole 242 connected to the drain pump is provided to an end of the other side of the drain channel 241. The soil sensor is a pollution measuring sensor detecting a pollution level of the water on performing washing. A soil sensor guide channel 233 is provided on the drain channel 241 to guide the water pumped from the pump case 256 to the soil sensor.

An impeller installing recess 257 is provided to a center of the pump case 256 to have the impeller 250 loaded therein. An outer circumference of the impeller installing recess 257 and an inner circumference of the pump case 256 form a pumping channel 258 via which the water flows by the impeller 250. Namely, the water introduced into the pump case 256 flows to the vario valve 260 along the pumping channel 258. Preferably, the pumping channel 258 has a predetermined depth attributed to an outer wall of the pump case 256.

A flow of the water in the above-configured sump according to the present invention is explained as follows.

First of all, as the wash motor 330 is rotated, the water stored in the bottom of the sum is sucked toward the impeller 250 loaded in the pump case 256. The water pumped by a rotation of the impeller 250 is passed through the lower filter 270 to be primarily purified. The water is then led to each of the upper and lower nozzles (not shown in the drawing) along the pumping channel 258 formed by the pump case 256 and the soil chamber 230. In doing so, the water diverges from the vario valve 260 to be guided by each of the lower nozzle guide channel 236 and the water guide channel 237.

The vario valve 260 allows the water to be led to either the upper nozzle or the lower nozzle during a predetermined time. After elapse of the predetermined time, the vario valve it turned on toward either the lower nozzle or the upper nozzle. Thus, the water can be evenly led to each of the upper and lower nozzles.

Meanwhile, a portion of the water guided by the channel passes through the soil sensor (not shown in the drawing) to be collected on the bottom of the sump along the drain channel 241 provided on the edge area of the soil chamber 230. In the drain process, the water flows in the drain pump case 296 and the drain impeller 310 is rotated to drain the water in case of actuating the drain water 300.

A backside of the sump and the wash motor in FIG. 2 are explained in detail with reference to FIG. 3 as follows.

Figure 3:
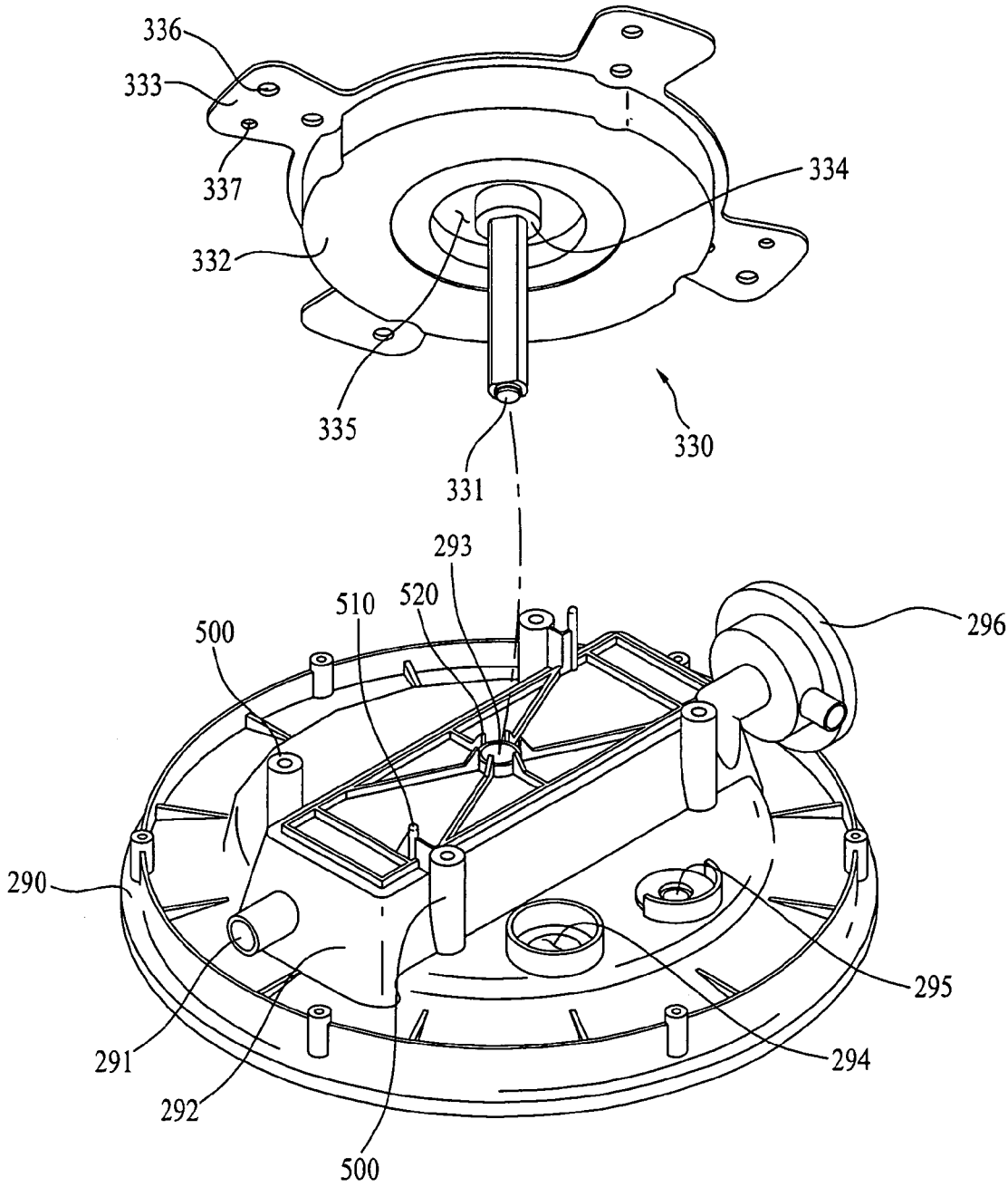
FIG. 3 is a perspective diagram of a backside of the sump and a wash motor in FIG. 2.

Referring to FIG. 3, the sump includes a sump housing 290 having a heater container 292 containing a heater therein and at least one motor guide rib 520 projected from a bottom of the heater container 292 and a wash motor 330 having a motor housing 332 provided with a rib container 335 containing the motor guide rib 520 therein.

The heater container 292 is recessed downward to the sump housing 290 and has an approximately rectangular bottom shape. And, each corner of the heater container 292 is smoothly curved. Yet, the shape and depth of the heater container 292 are not limited to those of the embodiment of the present invention but can be variously modified.

Meanwhile, at least one motor connecting boss 500 having a predetermined length and diameter is provided to one lateral side of the heater container 292. Preferably, four motor connecting bosses 500 are provided to form four corners. At least one location setting projection 510 is provided to a point leaving a predetermined distance from the at least one motor connecting boss 500 to assist the location setting of the wash motor 330. Preferably, the location setting projections 510 are diagonally located to each other.

At least one motor guide rib 520 is provided in a vicinity of a motor shaft penetrating hole 293 at a bottom center of the heater container 292 along a circumference of the motor shaft penetrating hole 293. Preferably, the at least one motor guide rib 520 is projected downward to have a predetermined length and a tip of the at least one motor guide rib 520 received in the rib container 335 has a hook shape. Yet, the shape and depth of the at least one motor guide rib 520 are not limited to those of the embodiment of the present invention but can be variously modified. And, the at least one motor guide rib 520 is fitted in the rib container 335 provided to the center of the motor housing 332 to play a role in preventing the wash motor 330 from being eccentric.

The wash motor 330 includes a motor shaft 331 projected from a center of the wash motor 330, a motor housing 332 protecting a stator and rotator within the wash motor, and at least one motor connecting wing 333 provided to a rim of the motor housing 332.

A motor bearing part 334 is provided to a lower end of the motor shaft 331 to have a motor bearing inserted therein, and a rib container 335 containing the motor guide rib 520 therein is provided to a periphery of the motor bearing part 334. The rib container 335 occupies a predetermined space within the motor housing 332 and is located to leave a predetermined distance from the motor shaft 331.

The at least one or more motor connecting wings 333 are provided to correspond to the at least one or more connecting bosses 500, respectively. An inserting hole 336 is provided to the motor connecting wing 333 to have a locking member inserted therein to be locked to the motor connecting boss 500. And, a location setting hole 337 is provided to at least one of the motor connecting wings 333 so that the location setting projection 510 formed at the bottom of the sump housing 290 can be fitted in the location setting hole 337.

Figure 4:
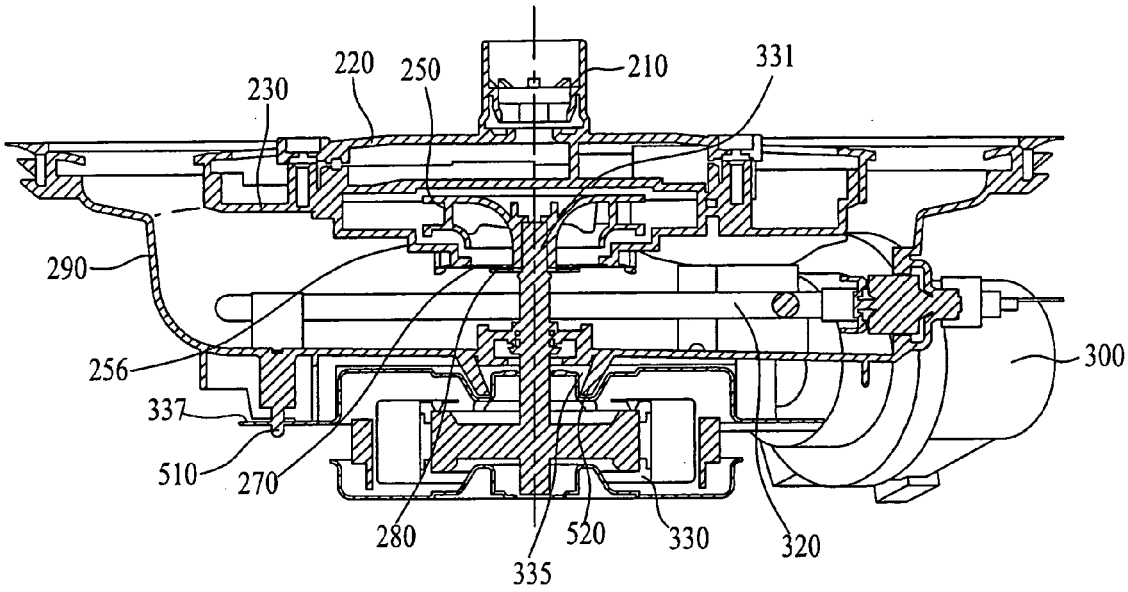
FIG. 4 is a cross-sectional diagram of an assembly of the sump and a wash motor in FIG. 2.

An assembly of the sump housing and the wash motor is explained with reference to FIG. 4 as follows.

First of all, the wash motor 330 is assembled to the bottom of the sump housing 290. Preferably, the motor shaft 331 provided to the center of the wash motor 330 is aligned to coincide with the center of the sump housing 290. One end of the motor shaft 331 is connected to the impeller 250 provided within the pump case 256.

A plurality of the motor guide ribs 520 projected from the bottom of the sump housing 290 are inserted in the rib container 335 provided to the motor housing. And, the location setting projection 510 provided to the heater container is fitted in the location setting hole 337 provided to the motor connecting wing 333. Thus, the motor connecting structure is doubly secured, whereby the motor can be securely loaded in the center of the sump housing without being eccentric from the sump center.

The present invention provides a dishwasher, by which noise and vibration of a wash motor can be lowered and by which endurance of the wash motor can be prolonged and by which an assembly of a wash motor and a sump can be simplified It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dishwasher comprising:

a sump housing having a heater container containing a heater therein and a plurality of motor guide ribs projected from a bottom outer surface of the heater container and extending lengthwise outwardly from a circumference having a predetermined radius from a hole penetrated by a motor shaft, to fasten a motor bearing part provided to a lower end of the motor shaft; and a wash motor having a motor housing which includes a rib container wherein an end of each of the plurality of motor guide ribs is disposed in the rib container.

2. The dishwasher of claim 1, wherein the hole is provided to a bottom center of the sump housing.

3. The dishwasher of claim 1, wherein one end of each of the plurality of motor guide ribs received in the rib container has a hook shape.

4. The dishwasher of claim 1, wherein at least one motor connecting boss is provided to a bottom of the sump housing and wherein at least one motor connecting wing is provided to the wash motor to correspond to the at least one motor connecting boss.

5. The dishwasher of claim 4, wherein the at least one motor connecting boss is provided to a lateral side of the heater container to have a predetermined length and wherein the at least one motor connecting wing is provided to a rim of the motor housing.

6. The dishwasher of claim 5, wherein inserting holes are provided to the at least one motor connecting boss and the at least one motor connecting wing, respectively to insert a locking member therein.

7. The dishwasher of claim 4, wherein a location setting hole for assisting a location setting of the wash motor is provided to the at least one motor connecting wing and wherein a location setting projection is provided to the bottom of the sump housing to correspond to the location setting hole.

8. The dishwasher of claim 7, wherein the location setting projections are arranged to confront each other diagonally.

* * * * *